US005963708A

United States Patent [19]

Wong

[11] Patent Number: 5,963,708

[45] Date of Patent: Oct. 5, 1999

[54] HEATING SYSTEM

[75] Inventor: Man Kwan Wong, Causeway Bay, The Hong Kong Special Administrative Region of the People's Republic of China

[73] Assignee: Well Men Industrial Co., Ltd., Quarry Bay, The Hong Kong Special Administrative Region of the People's Republic of China

[21] Appl. No.: 08/725,141

[22] Filed: Oct. 2, 1996

[51] Int. Cl.[6] ..... F24D 19/04; F22B 1/02; F16T 1/00

[52] U.S. Cl. ..... 392/352; 392/342; 122/488

[58] Field of Search ..... 392/339, 341–346, 392/347, 352–355, 375, 377; 126/101, 910; 165/181, 182, 183; 122/40, 4 R, 4 A, 34, 488, 492

[56] References Cited

U.S. PATENT DOCUMENTS

| | | | |
|---|---|---|---|
| 1,447,952 | 3/1923 | Head | 392/352 |
| 1,866,221 | 7/1932 | Pennington | 392/352 |
| 2,041,116 | 5/1936 | Kermor | 392/377 |
| 2,268,361 | 12/1941 | Walker et al. | 392/357 |
| 2,521,173 | 9/1950 | Koral | 392/357 |
| 3,559,886 | 2/1971 | Howard | 392/374 |
| 3,640,456 | 2/1972 | Sturgis | 392/352 |
| 3,750,371 | 8/1973 | Gutman | 122/492 |
| 3,830,293 | 8/1974 | Bell | 165/174 |
| 4,300,481 | 11/1981 | Fisk | 122/492 |
| 4,427,875 | 1/1984 | Fleming | 392/352 |
| 4,567,351 | 1/1986 | Kitagawa et al. | 392/352 |
| 4,791,274 | 12/1988 | Horst | 392/352 |

*Primary Examiner*—Teresa Walberg
*Assistant Examiner*—Sam Paik
*Attorney, Agent, or Firm*—Ladas & Parry

[57] ABSTRACT

A heating system for baseboard location has a chamber partly filled with liquid and sealed for holding a vacuum. A heater in the chamber heats the liquid into vapor to heat the chamber. First and second heat exchange plates extend annularly and substantially horizontally about the chamber with inner peripheries in heat-conducting contact with the chamber. The first heat exchange plate has at least one airflow hole therethrough on one side of the chamber and the second heat exchange plate has at least one air-flow hole therethrough on another side of the chamber. A space between the first and the second heat exchange plates is enclosed at the outer peripheries of the plates.

21 Claims, 4 Drawing Sheets

HEATING SYSTEM

Figure 1A:
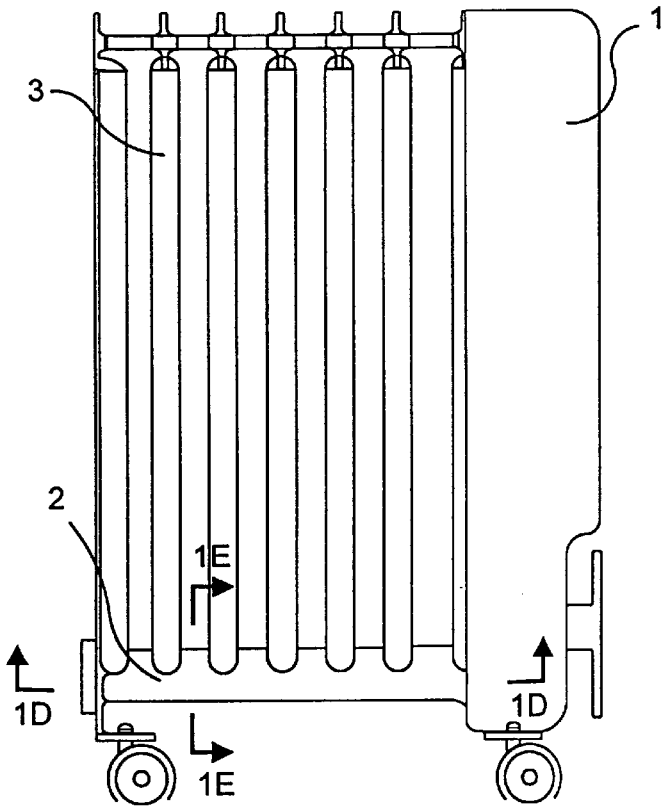
Figure 1B:
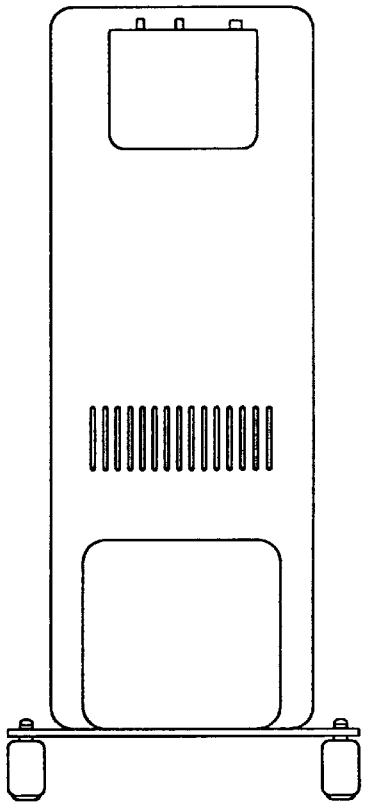
Figure 1C:
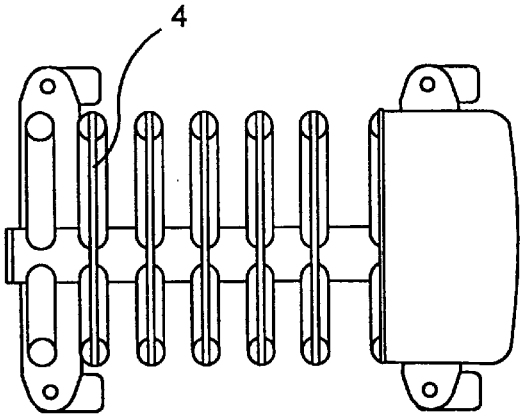
Figure 1D:
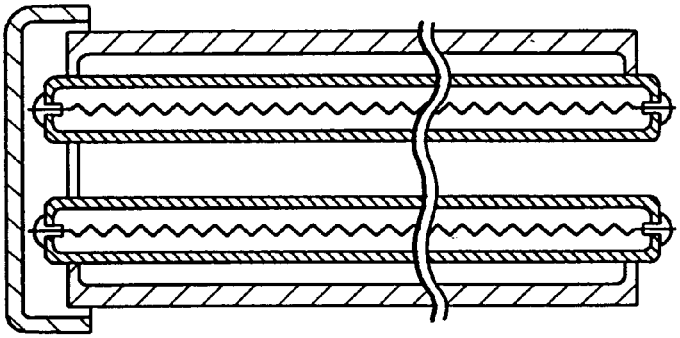
Figure 1E:
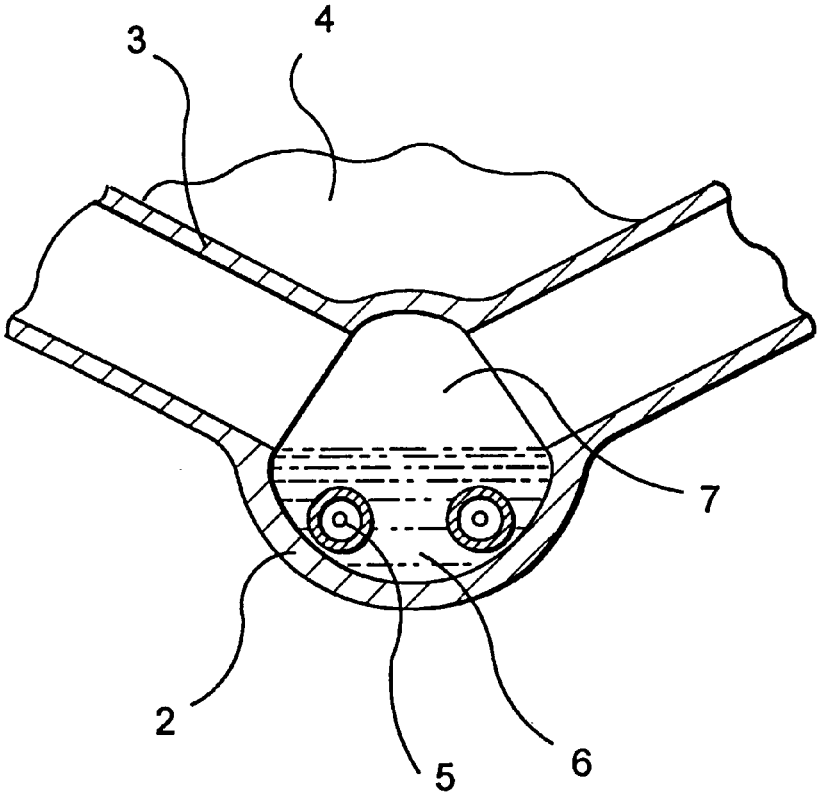

The basic idea of our US patent application is to rely on super fast heat conduction, the energy conducted through changes in state—between liquid and vapor. It can be applied in different types of heaters/radiators. It can replace traditional oil filled radiators, or it can be used for base board heaters. The attached FIGS. 1A to 1E, which are a front elevational view, right-side elevational view, top plan view, partial bottom plan sectional view on line 1D—1D in FIG. 1A and partial left-side elevational view on line 1E—1E in FIG. 1A, respectively of a first embodiment explain its different features. (1) End Cover (2) Large metal pipe (3) Small metal pipe. All small metal pipes are welded on to the large metal pipe (4) Metal radiating plates soldering on small and large metal pipes (5) electric sheath tube (6) water (including other suitable liquid) (7) vapor.

Tradition oil filled heaters rely on heating up the oil and causing a heat current that will transfer heat to the plates and thus allowing heat to radiate from the plates. This requires a lot of electricity in order to heat up the oil at the bottom to raise to a significant heat current level. Often this causes the temperature at the bottom to be higher than the top surface when the heat should really be at the top and not the bottom. This means that energy (electric) has been wasted. Moreover, the oil inside the radiator is a pollutant to the environment. When the oil filled radiator has been damaged and cannot be repaired, disposing it will be a big problem. The first thing you need to do is clear the oil inside.

Our design, as shown in FIGS. 1A to 1E, have both large and small pipes sealed and welded into a close circuit system. After we fill the system with a small volume of water (or other liquid), we suck out the air and try to make the pipe into a vacuum state. This causes the internal air pressure to become very low. When we heat up the electric sheath tube (5), low pressure and small volume of water enables water to heat up quickly and changes into vapor (7). Vapor rises along the small pipe and continuously hits the surrounding walls of the pipe. After a tremendous amount of energy has been released, vapor changes back into water drops and travels to the large pipe. The energy given out through condensation (vapor to water) is greater than any liquid can carry. Thus in a short moment of time, the temperature of the metal radiating plate rises. It has the following advantages over tradition oil filled radiators. (1) Takes shorter time to heat up (2) Requires less electricity (3) No environmental problems. We can use the same principle on other styles of heaters, like base board heaters (discussed on the neat paragraph). When water drops change into vapor, it relies on the heated pipes for energy. When vapor condenses back into water drops, energy will be released through the small pipes and metal radiating plates and heat will be radiated away. Water drops will once again change into vapor. Thus given enough electric energy, vaporization and condensation will repeat continuously and give out energy.

Figure 2:
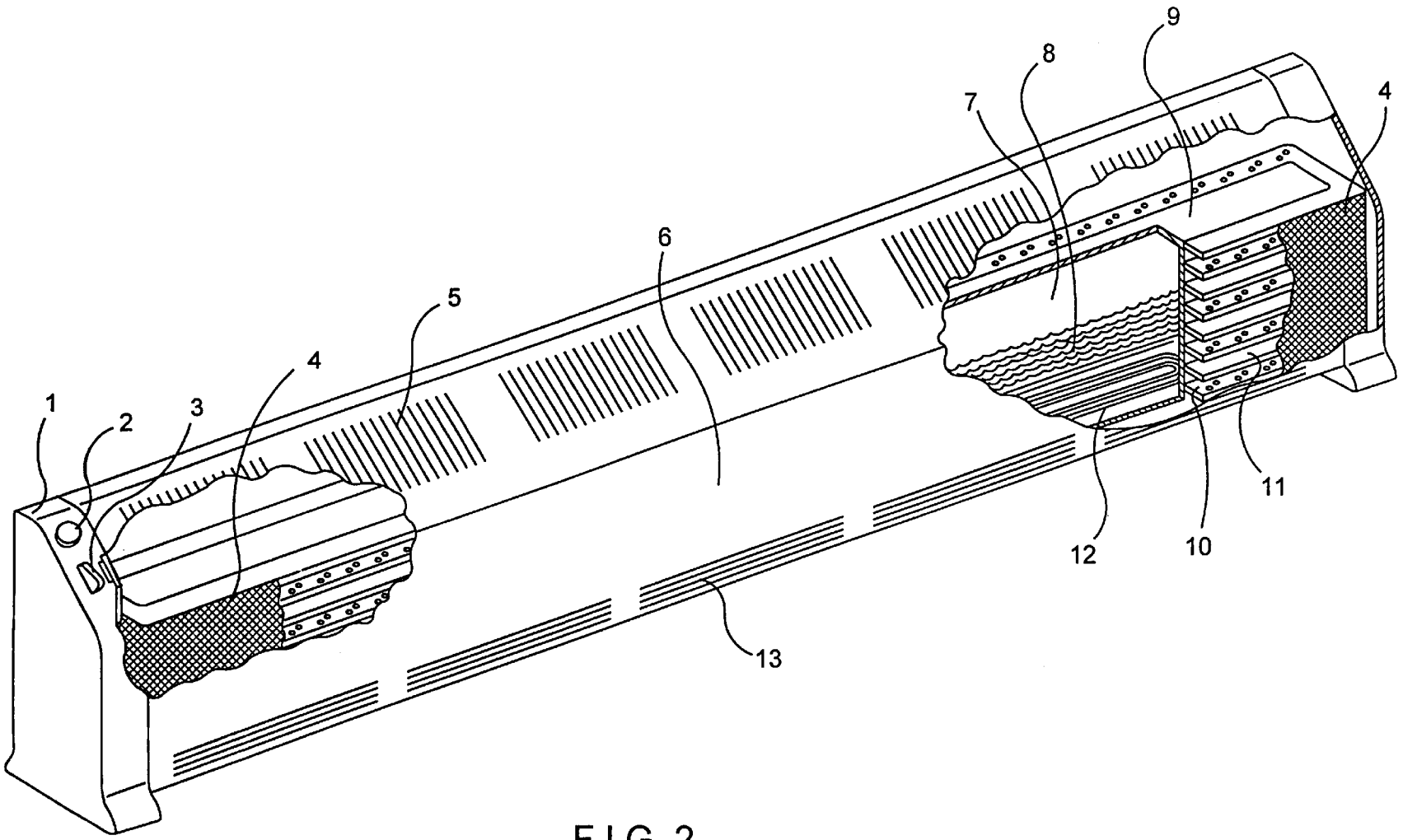

The second application is for the baseboard heater. Please refer to FIG. 2, which is a front/top/left-side perspective view of a second embodiment. (1) End cover (2) Thermostat (3) Main switch (4) Rubber belt to restrict and direct air movement (5) Grill or Window for hot/warm air outlet (6) Main shell (7) vapor (8) Water (9) Sealed water chamber (10) Heat exchange plate with ventilation holes in front (11) Heat exchanges with ventilation holes at the back (12) Electric sheath tube to heat up water and transform to vapor (13) Window for entering cold air.

The principle of this baseboard heater is similar to our first application. It relies on the energy released through condensation and vaporization. Actually, the design, construction and working principle of our heater is quite different form traditional baseboard heaters. The traditional baseboard heaters have the following disadvantages (a) Their heat pipe is connected to numerous small heat exchange plates. The distance between the plates is very small. When air heats up, it rises past the plates almost instantaneously. This short amount of time means that most of the heat still remains on the plate and not the air. The direct passage does not allow the air to be heated up thoroughly by the plates. Thus the air coming out is rather warm than hot. Efficiency has been lost here. (2) There are a lot of dead bugs, insects, dust hidden in between the small plates. It is quite impossible if not troublesome to clean. Our design does not have these disadvantages. (a) When the electric sheath tube (12) heats up the water, the water changes into vapor. The process and principle by which heat is produced is similar to our first application. When the water chamber (9) becomes hot, the heat exchange plates will also heat up. The heat exchange plates are arranged in a way that the ventilation holes are on the front or back of each alternate plate. Together with the rubber belt (4), the hot air is guaranteed to travel along a zigzag pattern. In other words, hot air passes through the hole in front but then is blocked by the rubber belt and forces it to travel horizontally and upwards through the hole at back. The hot air will continue to rise this way. This method allows more time for the air to be heated up since the air makes more contact with the heat exchange plates and the walls of the water chamber. Eventually, the air coming out will be real hot air and not just warm air. (2) Since the water chamber is sealed and the heat exchange plates are soldered onto the wall of the water chamber plus the edges of the plates are tightly sealed by the surrounding rubber belt, insects and dust will be difficult to enter. In other words, the space between the plates will remain clean all the time. (3) Same as our radiator, this item is more efficient and can save more on electricity bills (4) There are no harmful substances that will pollute the environment.

The air pressure inside the two heaters is about one percent of the outside pressure. The steam pressure needs to generate or increase the pressure by 100 times in order to be equal to the pressure outside or exceed the outside which is not likely. Vapor already changes back to water before it can reach that pressure that can cause explosion. Moreover, for extra precaution against explosion due to overheat, clients installed two thermostats and a fuse link to their heaters to control the temperature. One adjustable thermostat is connected to the heat exchange plates. One fixed temperature thermostat is connected to the water portion. The fuse link is connected to the electric sheath tube. All these three devices will prevent the heater to become over heated.

The basic idea of the design relies on super heat conducting. Due to the low pressure inside, water heats up quickly and changes to vapor. Vapor releases tremendous amount of energy when it makes contact with the surrounding walls and changes back to water. This energy will be given to the heat exchange plates as heat energy. This method of transferring heat by super heat conduction is faster than by any kind of material. For instance, it is 1400 times faster than copper. It is also much faster than oil filled heaters and require less wattage.

Figure 3:
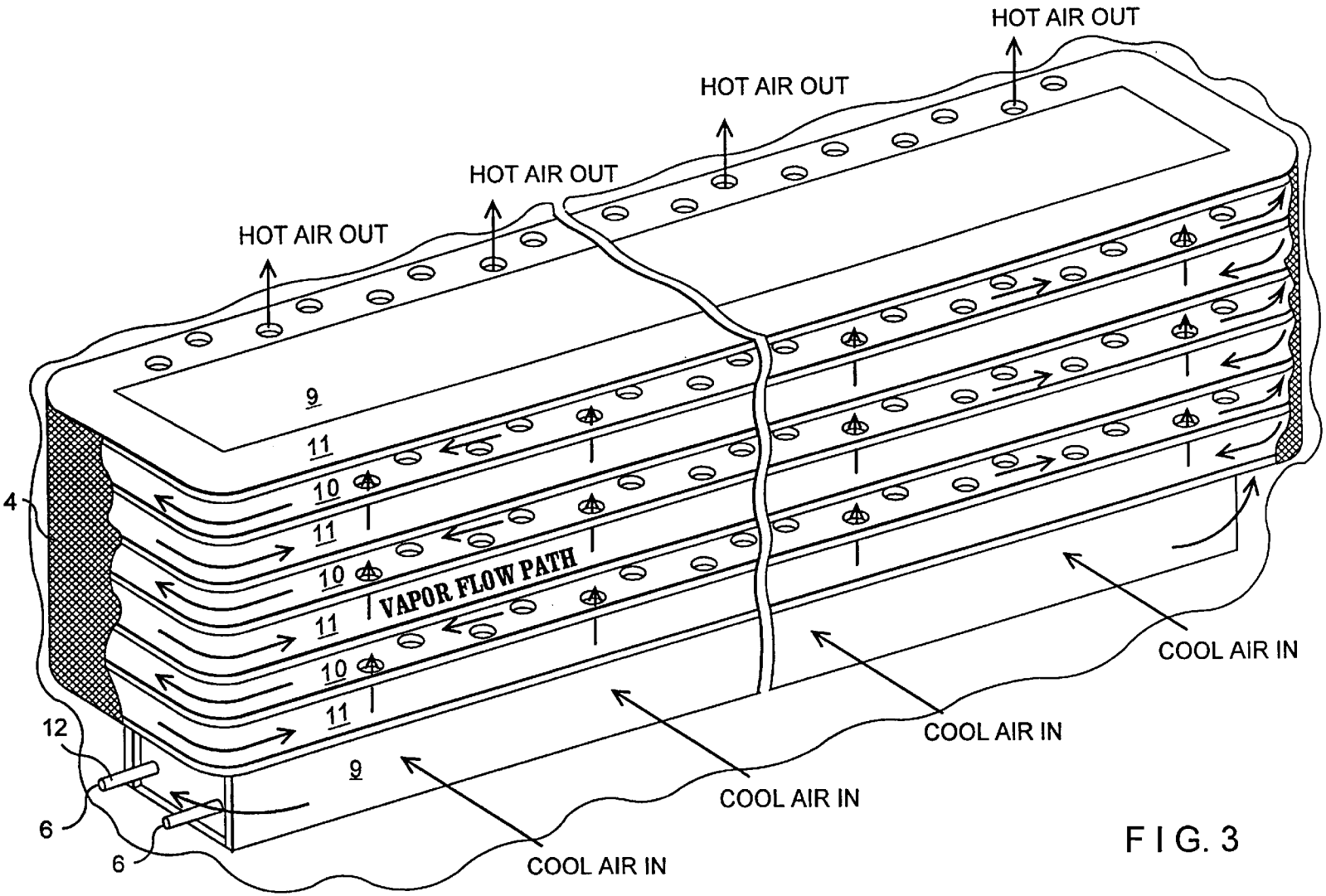

The boiling point inside is lower than the outside because the low air pressure inside lowers the boiling temperature. This enables the process of liquid transforming into vapor much faster. The heat conduction of this system does not depend on how low the boiling point is but the amount of vapor produced and the energy given out through the process of condensation and vaporization. Lower air pressure only speeds up this process. FIG. 3 is an enlarged front/top perspective view of the baseboard embodiment of FIG. 2 with the main shell (6 in FIG. 2) removed and some parts broken away. It is thus clear that the heat exchange plates 10, 11 are annular and in heat-conduction contact about their inner peripheries with the sealed chamber 9 that holds water, electric sheath tubes for boiling the water into steam to heat the chamber and, thus, heat exchange plates, and vacuum to make this faster and explosion proof for the volume of water in the chamber.

As the air in the spaces between the chamber, heat exchange plates and rubber belt is then heated by conduction and radiation from the chamber and heat exchange plates, it begins to rise as shown by the vertical arrows through the holes alternately in the fronts and backs of the heat exchange plates 10, 11. Rising hot air passing out through the back holes of the top heat exchange plate 11 is replaced by cool air flowing in through the back holes (not shown) of the bottom heat exchange plate 11, the cool air flowing in being shown in FIG. 3 by horizontal arrows because of the main shell shown in FIG. 2. The entering cool air is then heated as described to continue rising to replace the hot air out.

Because of the chamber 9 at the inner peripheries of the heat exchange plates 10 and 11 and the rubber belt about their outer peripheries, the heating cool air that came in at the bottom can only flow between the heat exchange plates and, because the holes in these are alternately at the fronts and backs, this requires the alternate right-hand and left-hand flow shown by the arrows at the right and left ends of FIG. 3. As a result, neither the volume nor speed of air flow is impeded, but the time the air is between the heat exchange plates and about the chamber is increased as compared to the conventional open-sided fin heat exchange plates of a conventional base board heater and the air flowing out is, therefore, hot, as marked in FIG. 3, rather than merely warm.

The partitions 10, 11 are heat exchange plates. There are ventilation holes either on the front of the plate or at the back but not together. The holes are arranged in such a way that heating air will make contact with as much surface area of the plates as possible and as long as possible. One of the possible arrangements of the plates is (a) bottom plate only has holes in front (b) next plate only has holes at back (c) third plate has holes in front. The pattern of the holes and plate will remain like this. Therefore, the hot air will go through a front hole and then up through back hole. The rubber belt acts as a wall to force the air move accordingly the path mentioned above, but also insulates the heating air until it exits out to heat an external space, as intended, as truly hot air.

However, the main purpose of the patent application is not the rubber belt but the following:

(a) Same as the radiator embodiment using the theory of super heat conduction, the energy released in the form of heat energy through condensation and vaporization is far greater than traditional methods. Thus, the time required for our client's baseboard heater to produce hot air is much faster;

(b) With traditional heaters, after the air is heated up, it will go directly straight upwards. Since the hot air travels upwards directly and immediately, the heat exchange plates will not have enough time to be heated up. Thus, the air released out is not really hot. It will take quite some time for the plates to be heated up and for this traditional heater to do what it is supposed to do, i.e., produce heat. With the design of alternating holes on the exchange plates, all the plates will be guaranteed to heat it up and, at the end, "real" hot air will be given out; and (c) Since our client's system is substantially closed by the rubber belt and holed heat exchange plates, dust and bugs will not enter in between of the heat exchange plates. This is the opposite from traditional heaters.

The above are merely preferred embodiments of the best modes now contemplated. Other variations, permutations and combinations as would be obvious to those skilled in the art are contemplated as equivalents within the scope of the following claims.

I claim:

1. A heating system for baseboard location, the system comprising:

a sealed chamber means for holding a vacuum and a volume of liquid that fills only a part of the chamber means;

heating means in the part of the chamber means when the chamber means is in a location for use for heating the liquid into a vapor, whereby to heat the chamber means;

at least one first and at least one second annular heat exchange plate having inner and outer peripheries, the first and second heat exchange plates being spaced from each other and extending annularly about the chamber means in a substantially horizontal orientation when the chamber means is in the location for use, the inner peripheries of the first and second heat exchange plates being in heat-conducting contact with the chamber means for conducting at least some of the heat therefrom, the first heat exchange plate having at least one air-flow hole therethrough on one side of the chamber means and the second heat exchange plate having at least one air-flow hole therethrough on another side of the chamber means; and enclosing means for enclosing the space between the first and second heat exchange plates at the outer peripheries thereof.

2. The system according to claim 1, wherein the vacuum, volume of liquid and heating means are selected the chamber means such that the vapor cannot explode the chamber means.

3. The system according to claim 1, wherein the liquid is water.

4. The system according to claim 2, wherein the liquid is water.

5. The system according to claim 1, wherein the heating means is an electric sheath tube.

6. The system according to claim 2, wherein the heating means is an electric sheath tube.

7. The system according to claim 3, wherein the heating means is an electric sheath tube.

8. The system according to claim 4, wherein the heating means is an electric sheath tube.

9. The system according to claim 1, wherein the one side of the chamber means is opposite the other side of the chamber means.

10. The system according to claim 2, wherein the one side of the chamber means is opposite the other side of the chamber means.

11. The system according to claim 3, wherein the one side of the chamber means is opposite the other side of the chamber means.

12. The system according to claim 4, wherein the one side of the chamber means is opposite the other side of the chamber means.

13. The system according to claim 5, wherein the one side of the chamber means is opposite the other side of the chamber means.

14. The system according to claim 8, wherein the one side of the chamber means is opposite the other side of the chamber means.

15. The system according to claim 1, wherein the enclosing means is a rubber-like insulating belt.

16. The system according to claim 2, wherein the enclosing means is a rubber-like insulating belt.

17. The system according to claim 4, wherein the enclosing means is a rubber-like insulating belt.

18. The system according to claim 5, wherein the enclosing means is a rubber-like insulating belt.

19. The system according to claim 8, wherein the enclosing means is a rubber-like insulating belt.

20. The system according to claim 9, wherein the enclosing means is a rubber-like insulating belt.

21. The system according to claim 14, wherein the enclosing means is a rubber-like insulating belt.

* * * * *